US009409673B2

(12) United States Patent
Brandt et al.

(10) Patent No.: US 9,409,673 B2
(45) **Date of Patent: *Aug. 9, 2016**

(54) PALLET WITH SINGLE LAYER TOP DECK HAVING INSERTS THEREIN AND RELATED METHODS

(71) Applicant: CHEP Technology Pty Limited, Sydney (AU)

(72) Inventors: Ken Brandt, Orlando, FL (US); Christopher Scott Lundquist, Columbus, OH (US); David Paul Anderson, III, Orlando, FL (US); Daniel J. Lantz, Orlando, FL (US)

(73) Assignee: CHEP Technology Pty Limited, Sidney (AU)

( * ) Notice: Subject to any disclaimer, the term of this patent is extended or adjusted under 35 U.S.C. 154(b) by 37 days.

This patent is subject to a terminal disclaimer.

(21) Appl. No.: 13/750,314

(22) Filed: Jan. 25, 2013

(65) Prior Publication Data

US 2014/0208989 A1 Jul. 31, 2014

(51) Int. Cl.
*B65D 19/38* (2006.01)
*B65D 19/00* (2006.01)

(52) U.S. Cl.
CPC .. *B65D 19/0095* (2013.01); *B65D 2519/00029* (2013.01); *B65D 2519/00039* (2013.01); *B65D 2519/00064* (2013.01); *B65D 2519/00129* (2013.01); *B65D 2519/00273* (2013.01); *B65D 2519/00293* (2013.01); *B65D 2519/00323* (2013.01); *B65D 2519/00333* (2013.01); *B65D 2519/00437* (2013.01); *B65D 2519/00572* (2013.01); *B65D 2519/00796* (2013.01); *B65D 2519/00945* (2013.01); *Y10T 29/49826* (2015.01)

(58) Field of Classification Search
CPC ..... B65D 2519/00293; B65D 2519/00323; B65D 2519/00572; B65D 19/0095
USPC ..... 108/56.1, 56.3, 57.21–57.24, 108/57.17–57.2, 51.11
See application file for complete search history.

(56) References Cited

U.S. PATENT DOCUMENTS 2,347,095 A * 4/1944 Garbarino ..... 108/56.1
2,764,377 A * 9/1956 Schoenecker ..... 108/54.1

(Continued)

FOREIGN PATENT DOCUMENTS

JP 2009046135 3/2009
WO 2013010920 1/2013

*Primary Examiner* — Daniel J Troy
*Assistant Examiner* — Timothy M Ayres
(74) *Attorney, Agent, or Firm* — Allen, Dyer, Doppelt, Milbrath & Gilchrist, P.A.

(57) ABSTRACT

A pallet includes a cargo layer, a base layer and support structures coupled between. The cargo layer includes a pair of horizontally positioned outer deck boards and at least one horizontally positioned intermediate deck board therebetween. The at least one horizontally positioned intermediate deck board has opposing sidewalls, and a spaced apart openings at least partially extending through the opposing sidewalls. The pair of horizontally positioned outer deck boards have opposing sidewalls, and spaced apart openings extending through at least one of the sidewalls of each outer deck board. The spaced apart openings in each horizontally positioned outer deck board are aligned with the spaced apart openings in an adjacent sidewall of least one horizontally positioned intermediate deck board. Inserts are in the spaced apart openings.

19 Claims, 9 Drawing Sheets

(56) References Cited

U.S. PATENT DOCUMENTS

| | | | | | |
|---|---|---|---|---|---|
| 2,783,960 | A | * | 3/1957 | Herz et al. | 108/56.1 |
| 3,016,222 | A | * | 1/1962 | Arthur | 108/56.1 |
| 3,059,887 | A | * | 10/1962 | Ward, Jr. | 108/57.21 |
| 3,256,839 | A | | 6/1966 | Peterson et al. | |
| 3,355,167 | A | * | 11/1967 | Rceves | 271/148 |
| 3,513,786 | A | * | 5/1970 | Kellogg | 108/64 |
| 3,650,225 | A | | 3/1972 | Ball | |
| 3,651,769 | A | * | 3/1972 | Foley | 108/56.1 |
| 3,654,877 | A | | 4/1972 | Barrett | |
| 4,240,358 | A | * | 12/1980 | Munroe | 108/57.2 |
| 4,802,421 | A | | 2/1989 | Atterby et al. | |
| 4,831,938 | A | | 5/1989 | Atterby et al. | |
| 4,834,001 | A | | 5/1989 | Atterby et al. | |
| 4,869,179 | A | * | 9/1989 | Sammons et al. | 108/56.1 |
| 5,255,614 | A | | 10/1993 | Voss-Schrader et al. | |
| 5,402,735 | A | | 4/1995 | DeJean | |
| 5,562,047 | A | * | 10/1996 | Forney et al. | 108/57.13 |
| 5,664,899 | A | | 9/1997 | Eustis | |
| 5,685,233 | A | | 11/1997 | DeJean | |
| 6,112,673 | A | | 9/2000 | Gomez | |
| 6,216,608 | B1 | | 4/2001 | Woods et al. | |
| 6,938,558 | B1 | | 9/2005 | Peres | |
| 7,987,796 | B2 | | 8/2011 | Nordstrom et al. | |
| 8,261,673 | B2 | | 9/2012 | Ingham | |
| 8,448,582 | B2 | | 5/2013 | Jian | |
| 8,667,905 | B2 | * | 3/2014 | Anderson et al. | 108/51.11 |
| 2006/0032411 | A1 | * | 2/2006 | Hummel et al. | 108/53.3 |
| 2007/0204766 | A1 | * | 9/2007 | Hedstrom | 108/51.11 |
| 2009/0320723 | A1 | | 12/2009 | Low | |
| 2010/0236456 | A1 | | 9/2010 | Haaf | |

* cited by examiner

PALLET WITH SINGLE LAYER TOP DECK HAVING INSERTS THEREIN AND RELATED METHODS

FIELD OF THE INVENTION

The present invention relates to the field of pallets, and more particularly, to a pallet accessible from all four sides while having a sufficient load bearing capacity, and related methods for making the same.

BACKGROUND OF THE INVENTION

Conventional pallets are typically made of wood and include a base layer and a cargo layer separated therefrom by support blocks. The base and cargo layers are also referred to as bottom and top decks. Traditionally, the base and cargo layers are multiple layers, with each layer respectively having end deck boards assembled on connector boards that run the full length or width of the pallet. The end deck boards are nailed through the connector boards into the support blocks to build the primary structure of the pallet. The end deck boards are also known as lead boards. Intermediate deck boards are placed between the end deck boards.

To move the pallet with cargo thereon, tines from a forklift or a pallet jack are inserted into the gaps between the base and cargo layers on a lead board side of the pallet. If the tines were to be inserted into the gaps on a non-lead board side of the pallet, then the pallet would likely be over stressed if the cargo placed therein is relatively heavy, resulting in potential damage or weakening of the pallet.

In large open areas, maneuvering a forklift or a pallet jack so that the tines can enter into the gaps between the base and cargo layers on the lead board side of the pallet is relatively straightforward. However, maneuvering such a lifting device becomes much more cumbersome in confined areas since the pallet can only be accessed from 2 different sides.

Even if conventional pallets are reduced in size from full size to half size or quarter size, the difficulty may still exist in maneuvering the lifting device since the pallet can only be accessed from 2 different sides. For example, a confined area may be a display or showroom floor within a store. Instead of removing the cargo from the pallets, the cargo remains on the pallet for viewing by the customers.

Consequently, there is a need for a pallet that can be accessed from all four sides. Since the cargo to be carried by the top deck at times may be relatively heavy, the load carrying capacity of the pallet should not be sacrificed while also providing accessibility.

One approach for such a pallet is disclosed in U.S. Pat. No. 4,834,001. The pallet has a base member provided with recesses for the tines of a lifting device. The base member also includes a number of holes perpendicularly to their length direction through which tubes can be inserted so as to unite the base members with each other to form the pallet.

U.S. Pat. No. 5,402,735 discloses a pallet that includes a plurality of runners. Each runner defines an upper load supporting surface, an opposed bottom surface having formed therein a tab locating channel, and a pair of opposed lateral surfaces. Each lateral surface has formed therethrough a predetermined number of bar locating apertures. A plurality of bars is uniquely sized for the individual load to be handled. The bars are insertably received by a respective bar locating aperture of an individual runner. At least one stabilizer has a main body and a predetermined number of tab members made integral with the stabilizer main body. Each tab member is received by the tab locating channel of an individual runner.

Yet another approach is disclosed in U.S. Pat. No. 6,112,673 which provides a pallet assembly comprising a first rail member and a second rail member spaced from the first rail member. At least one hollow pipe member extends between the first rail member and the second rail member with a sheet member positioned on the pipe member. A rod is positioned within each pipe member and extends through the first rail member and the second rail member. A fastening mechanism is associated with each rod for releasably fastening the first rail member to the second rail member, and for releasably fastening each hollow pipe member and the sheet member between the first rail member and the second rail member. Not withstanding the above described pallets, there is still a need to improve on such pallets.

SUMMARY OF THE INVENTION

In view of the foregoing background, it is therefore an object of the present invention to provide a pallet that can be accessed from all four sides without sacrificing its load bearing capacity.

This and other objects, features, and advantages in accordance with the present invention are provided by a pallet comprising a cargo layer comprising a pair of horizontally positioned outer deck boards and at least one horizontally positioned intermediate deck board therebetween. The at least one horizontally positioned intermediate deck board may have opposing sidewalls, and a plurality of spaced apart openings at least partially extending through the opposing sidewalls. The pair of horizontally positioned outer deck boards may have opposing sidewalls, and a plurality of spaced apart openings extending through at least one of the sidewalls of each outer deck board. The plurality of spaced apart openings in the sidewalls of each horizontally positioned outer deck board may be aligned with the plurality of spaced apart openings in an adjacent sidewall of the at least one horizontally positioned intermediate deck board.

A plurality of inserts may be in the plurality of spaced apart openings. A base layer may comprise a plurality of horizontally positioned deck boards orthogonal to the pair of horizontally positioned outer deck boards and the at least one horizontally positioned intermediate deck board in the cargo layer. A plurality of spaced apart support structures may be coupled between the base and cargo layers and forming gaps therebetween for receiving a lifting member.

Each insert may be orthogonal to the pair of horizontally positioned outer deck boards and the at least one horizontally positioned intermediate deck board in the cargo layer. Each insert may comprise a metal pipe or solid rod, for example.

The cargo layer is thus a single layer top deck with inserts therein. Since the inserts and the boards in the base layer are orthogonal to the boards in the cargo layer, this allows for the pallet to have a strong load bearing capacity/racking strength while allowing accessibility from all 4 sides. The pallet is not limited to any particular size, and may be configured as a full, half or quarter size pallet, for example.

In one embodiment, the plurality of spaced apart openings at least partially extending through the opposing sidewalls of the at least one horizontally positioned intermediate deck board may include a first partially extending opening through one of the sidewalls and a second partially extending opening through the other sidewall. The first and second partially extending openings may be aligned and contacting one another so as to form a continuous opening therethrough. The plurality of inserts may comprise a single insert extending between openings in the pair of horizontally positioned outer deck boards and through the continuous opening in the at least one horizontally positioned intermediate deck board.

In another embodiment, the first and second partially extending openings in the at least one horizontally positioned intermediate deck board are aligned but do not contact one another. The plurality of inserts may comprise separate inserts extending between openings in the pair of horizontally positioned outer deck boards and the first and second partially extending openings in the at least one horizontally positioned intermediate deck board.

In yet another embodiment, the first and second partially extending openings in the at least one horizontally positioned intermediate deck board are not aligned and do not extend through to the opposing sidewall. The plurality of inserts may comprise separate inserts extending between openings in the pair of horizontally positioned outer deck boards and the first and second partially extending openings in the at least one horizontally positioned intermediate deck board.

The pair of horizontally positioned outer deck boards and the at least one horizontally positioned intermediate deck board may have a thickness T, and wherein an outside diameter of each insert is within a range of 0.25 T and 0.75 TH. For example, T may be equal to 1 inch, and wherein the outside diameter of each insert is within a range of 0.25 and 0.75 inches.

Each insert may overlie a respective horizontally positioned deck board in the base layer. Each support structure may be C-shaped or U-shaped. The pallet may further comprise a plurality of fasteners coupling the base and cargo layers to the plurality of spaced apart support structures.

Another aspect is directed to a cargo layer as described above.

Yet another aspect is directed to a method for making a pallet as also described above.

DETAILED DESCRIPTION OF THE PREFERRED EMBODIMENTS

Figure 1:
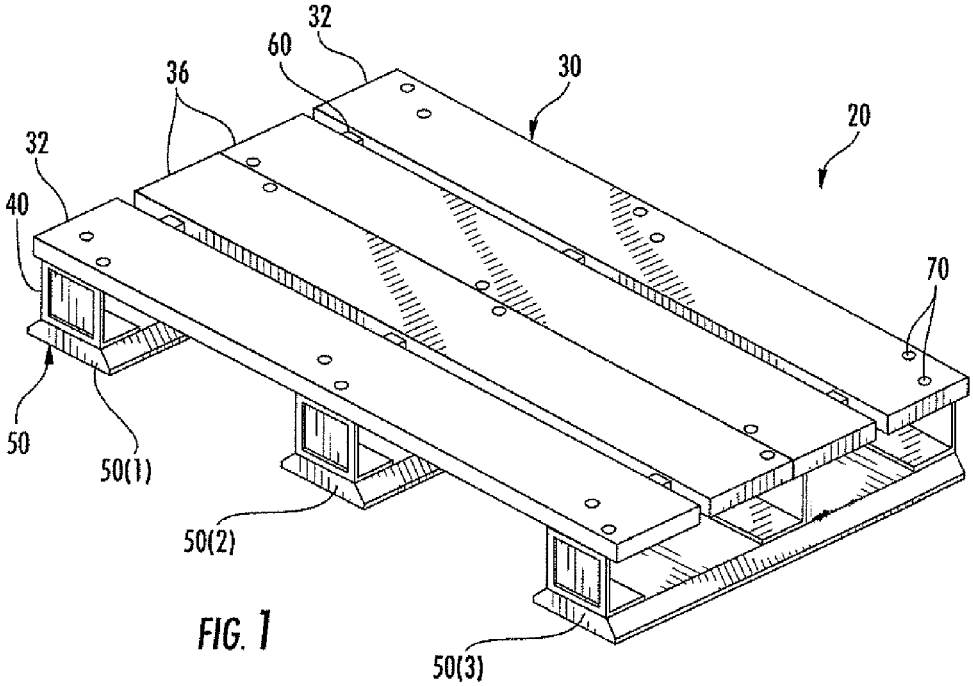
FIG. 1 is a top perspective view of a pallet with a single layer top deck having inserts therein in accordance with the present invention.
Figure 2:
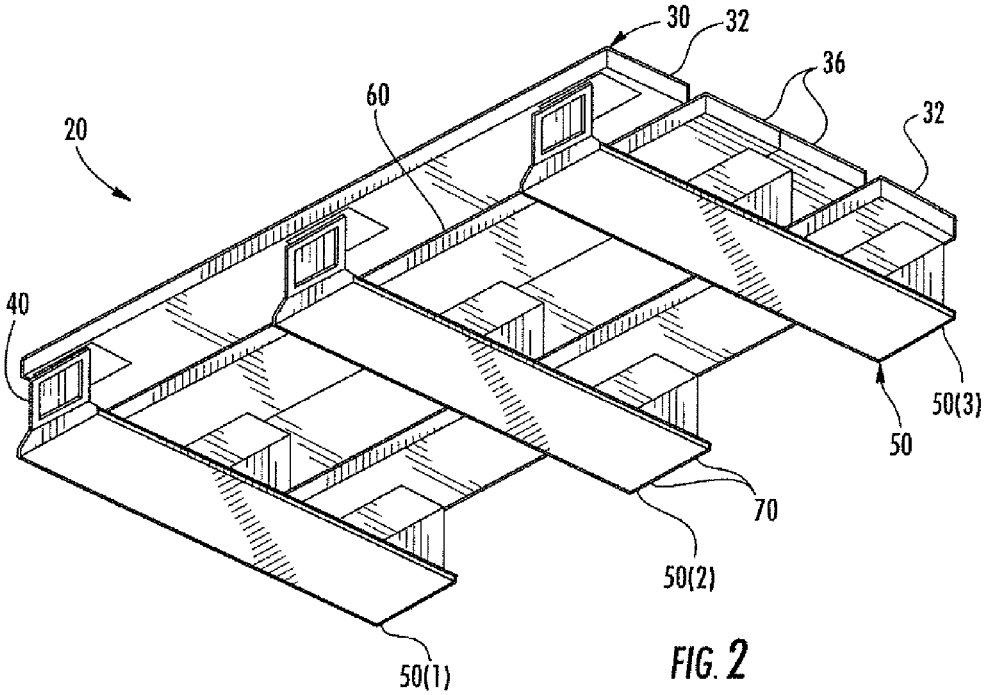
FIG. 2 is a bottom perspective view of the pallet shown in FIG. 1.
Figure 3:
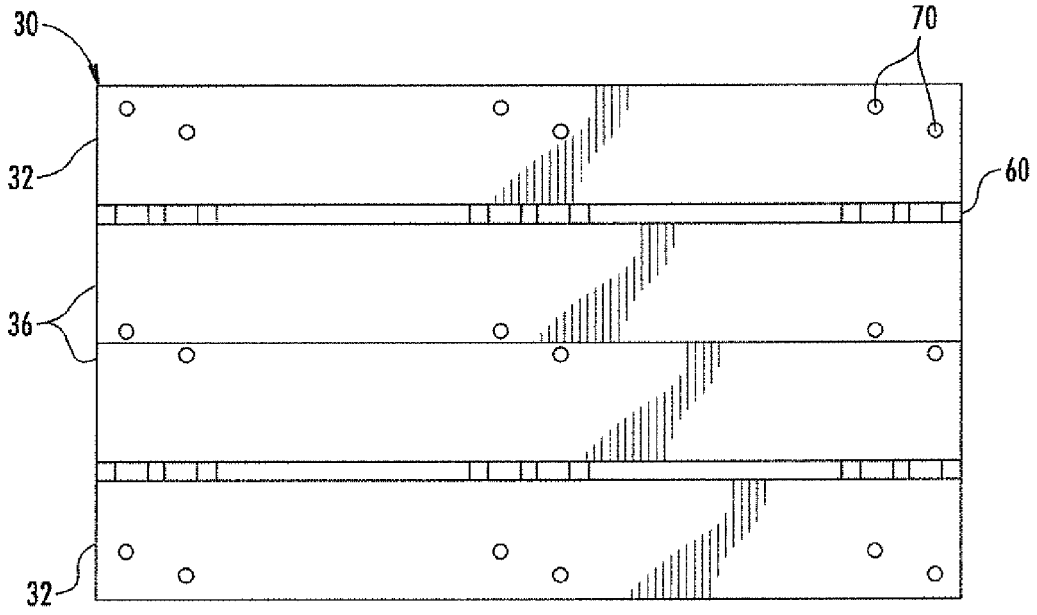
FIG. 3 is a top planer view of the pallet shown in FIG. 1.
Figure 4:
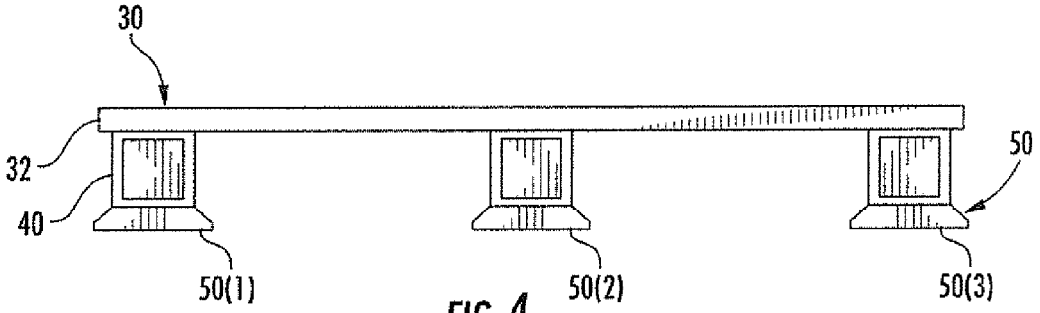
FIG. 4 is a side view of the pallet shown in FIG. 1.
Figure 5:
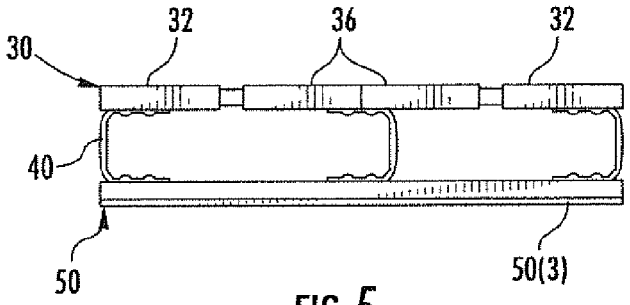
FIG. 5 is an end view of the pallet shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notations are used to indicate similar elements in alternative embodiments.

Referring initially to FIGS. 1-5, the illustrated pallet 20 includes a cargo layer 30, a base layer 50, and support structures 40 therebetween. The cargo layer 30 is a single layer top deck with inserts 60 therein. The inserts 60 and the boards in the base layer 50 are orthogonal to the boards in the cargo layer 30. This allows for the pallet 20 to have a strong handling capacity/racking strength while allowing accessibility from all four sides. The pallet 20 is not limited to any particular size, and may be configured as a full, half or quarter size pallet. For discussion purposes, the illustrated pallet 20 is a half size pallet, i.e., 40 inches by 24 inches.

More particularly, the cargo layer 30 comprises a pair of horizontally positioned outer deck boards 32 and at least one horizontally positioned intermediate deck board 36 therebetween. In the illustrated embodiment, there is a pair of intermediate deck boards 36.

Figure 6:
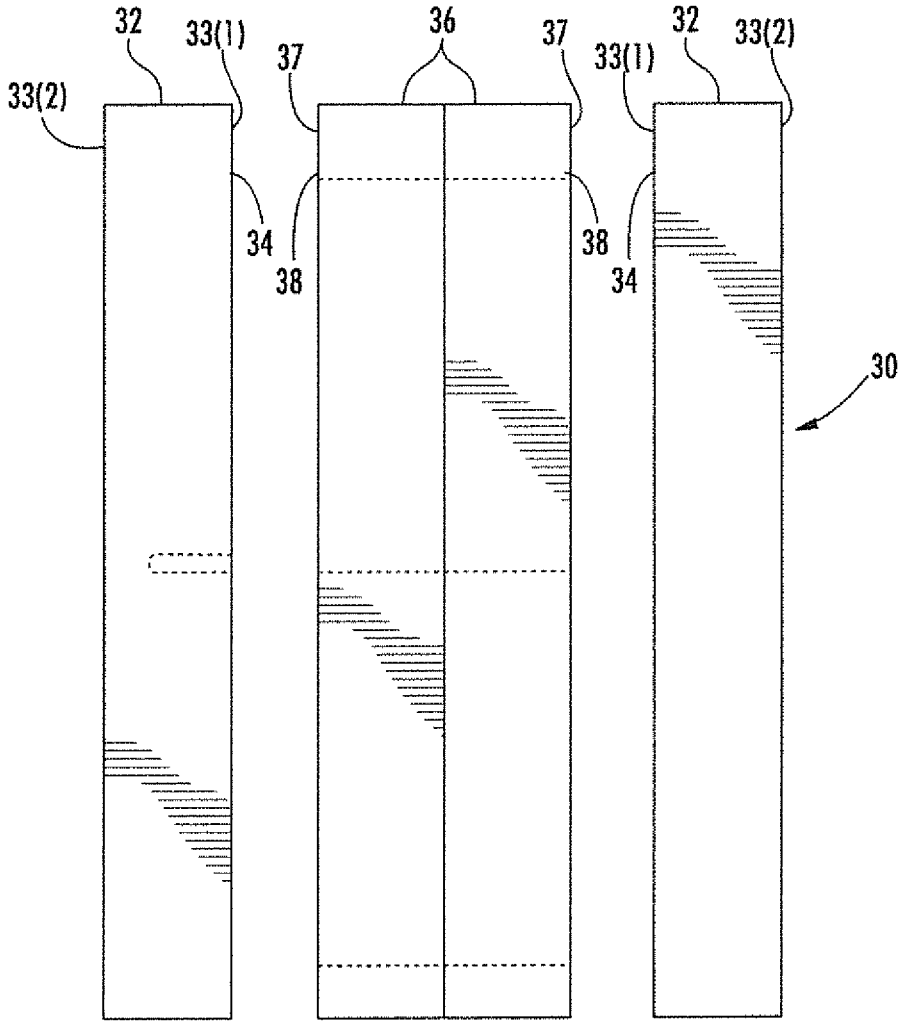
FIG. 6 is a top planer view of the cargo layer without the inserts in accordance with the present invention.

Each horizontally positioned intermediate deck board 36 has opposing sidewalls 37, and a plurality of spaced apart openings 38 extending through the opposing sidewalls, as best illustrated in FIG. 6. Similarly, each horizontally positioned outer deck board 32 has opposing inner and outer sidewalls 33(1), 33(2), and a plurality of spaced apart openings 34 extending through the inner sidewalls 33(1). The corresponding opposing portions of the outer sidewalls 33(2) are closed off. Consequently, the openings 34 terminate within each end deck board 32 short of the opposing portions of the outer sidewall 33(2). In other embodiments, the openings 34 may extend through to the outer sidewalls 33(2).

The spaced apart openings 34 in the pair of horizontally positioned outer deck boards 32 are aligned with the spaced apart openings 38 in each horizontally positioned intermediate deck board 36.

Inserts 60 are inserted into the openings 34, 38. For the illustrated pallet 20, there are three inserts 60.

Figure 7:
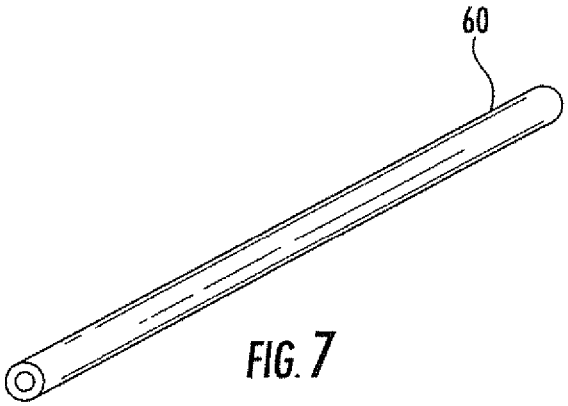
FIG. 7 is a side perspective view of an insert for the cargo layer shown in FIG. 6.

Each insert 60 may be an open pipe, for example, as illustrated in FIG. 7. The pipe may be made out of metal or galvanized steel, for example. A diameter of the insert 60 is selected based on the thickness of the boards 32, 36 in the cargo layer 30 so as to provide an increased racking strength for the pallet 20 while leaving a sufficient amount of wood between each opening 34, 38 and the outer surfaces of each board in the cargo layer 30.

Figure 8:
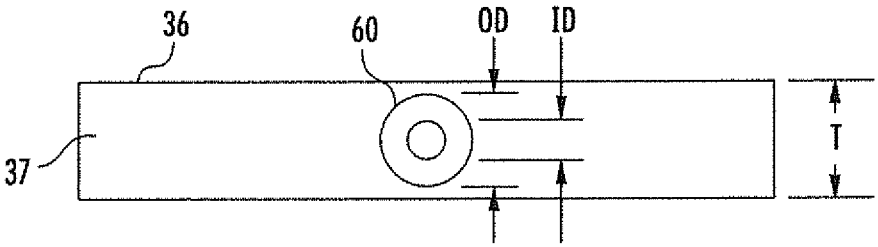
FIG. 8 is a side view of an intermediate deck board with an insert therein in accordance with the present invention.

As illustrated in FIG. 8, the thickness of the boards 32, 36 is represented by T, where an outside diameter of each insert 60 is preferably within a range of 0.25 T and 0.75 T. For example, the thickness of each board 32, 36 is about 1 inch, wherein the diameter of the insert 60 is within a range of about 0.25 and 0.75 inches. In one embodiment, the insert 60 has an outside diameter of ⅝ inch and an inside diameter of ⅜ inch. With this particular combination of insert size and deck board thickness, the racking strength of the half size pallet 20 is about 1400 pounds.

Figure 9:
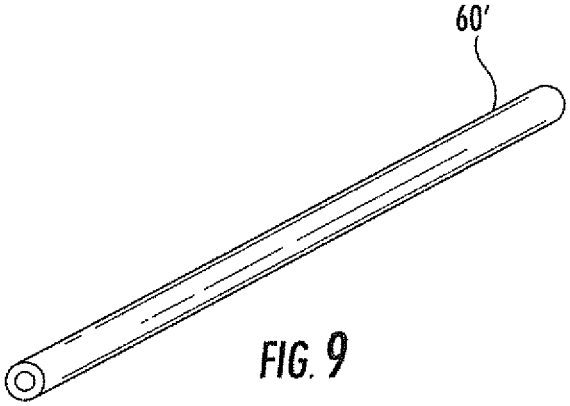
FIG. 9 is a side perspective view of an alternative embodiment of the insert shown in FIG. 7.
Figure 10:
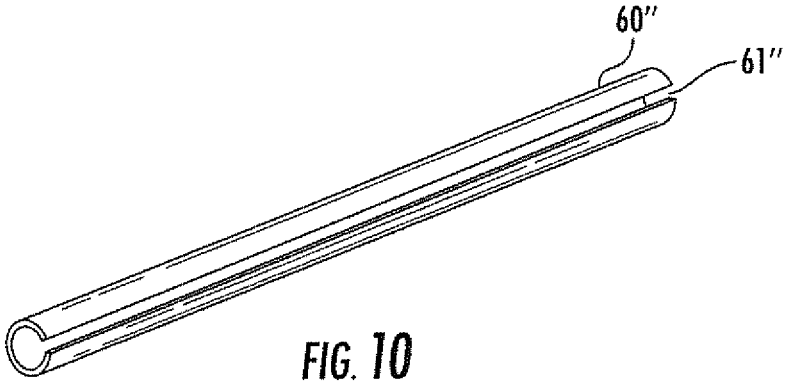
FIG. 10 is a side perspective view of yet another alternative embodiment of the insert shown in FIG. 11 is a bottom perspective view of another embodiment of the pallet shown in FIG. 1 with a non-centered base layer.

As an alternative, the insert may be a solid rod 60', as illustrated in FIG. 9. In yet another embodiment, the insert 60" is a spring pin as illustrated in FIG. 10. The spring pin 60" has an opening 61" along its longitudinal length. The spring pin 60" is collapsed to fit within the respective openings 34, 38. Once inserted, the spring 60" then expands to holds the deck boards 32, 36 in place.

The base layer 50 includes a plurality of horizontally positioned deck boards 50(1),50(2), 50(3) orthogonal to the pair of horizontally positioned outer deck boards 32 and each horizontally positioned intermediate deck board 36 in the cargo layer 30. The base layer 50 does not include any deck boards extending in the same direction as the deck boards 32, 36 in the cargo layer 30. The lack of the base layer 50 not including deck boards orthogonal to the illustrated deck boards 50(1), 50(2), 50(3) advantageously reduces the weight and cost of the pallet 20 while not affecting its handling capacity.

In the illustrated pallet 20, there are nine spaced apart support structures 40 coupled between the base and cargo layers 30, 50. Each support structure 40 is made out of metal, and is "C" or "U" shaped. The support structures 40 allows for gaps to be formed for receiving the tines from a lifting member from any side of the pallet 20. As an alternative, anyone or all of the illustrated support structures 40 may have a different shape and composition. For example, the middle support blocks contacting the intermediate deck boards 36 may be square wooden blocks.

To secure the deck boards 32, 36 in the cargo layer 30 to the support structures 40, fasteners 70 are used. The fasteners 70 may be threaded bolts or rivets, for example. If the support structures 40 were formed out of wood, for example, then the fasteners would be nails or screws, for example. referably the upper surface of each fastener 70 is recessed or flush with the exposed outer surface of each deck board 32, 36. Similarly, fasteners 70 are used to secure the deck boards 50(1), 50(2), 50(3) in the base layer 50 to the support structures 40.

The illustrated pallet 20 is a self-reinforcing pallet in the sense that fasteners are not needed for the inserts 60 since they are press fit into their respective openings 34 and 38, and that the upper deck boards 32, 36 and the bottom deck boards 50(1)-50(3) are coupled to the fasteners 40 in an orthogonal fashion. This configuration advantageously allows for a strong pallet 20 that is lightweight and relatively straightforward to access with a lifting device.

Figure 11:
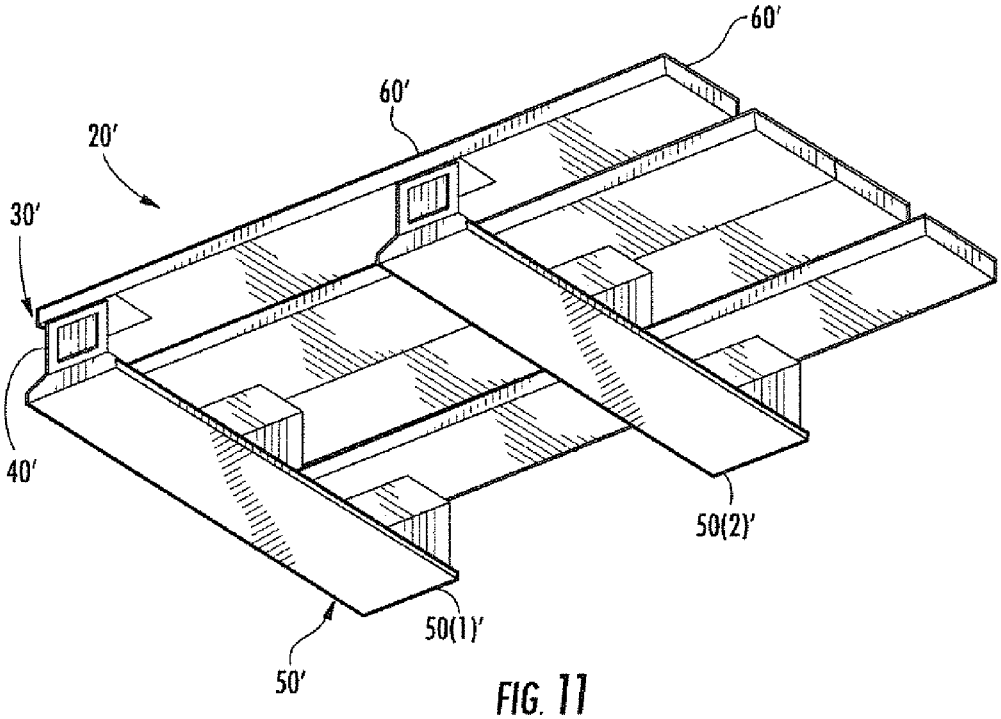

As illustrated in the figures, each insert 40 overlies a respective horizontally positioned deck board 50(1)-50(3) in the base layer 50. As an alternative embodiment, instead of three evenly spaced bottom deck boards 50(1)-50(3), there are two deck boards 50(1)', 50(2)' as illustrated in FIG. 11. The middle deck board 50(2)' is no longer in the center of the pallet 20' but is offset toward the location where the third deck board was initially located.

Figure 12:
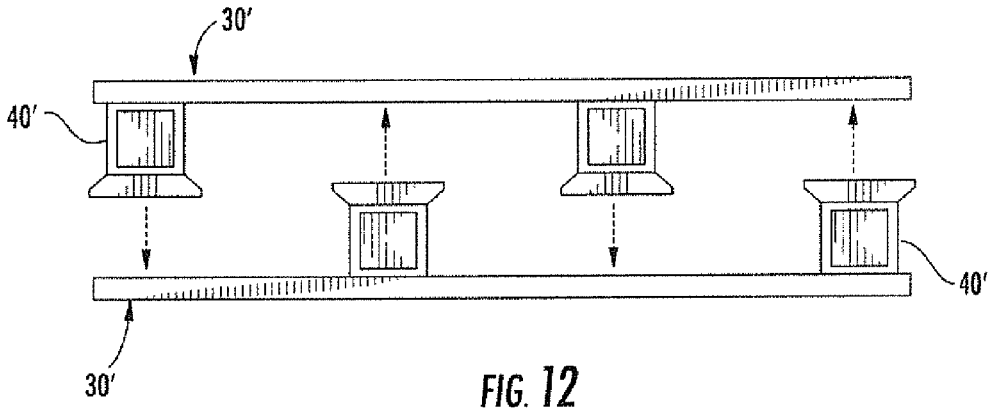
FIG. 12 is a side view of the pallet shown in FIG. 11 nested or stacked with another pallet.

This particular configuration allows two pallets 20' to be nested or stacked when not in use. As illustrated in FIG. 12, the bottom deck boards 50(1)', 50(2)' for each pallet 20' are adjacent one another with the cargo layers 30' being the outermost exposed surfaces.

The inserts 60' may be in their original position as for the embodiment illustrated in FIGS. 1-5. Alternatively, the center insert 60' is also offset to overlie the bottom deck board 50(2)'.

Figure 13:
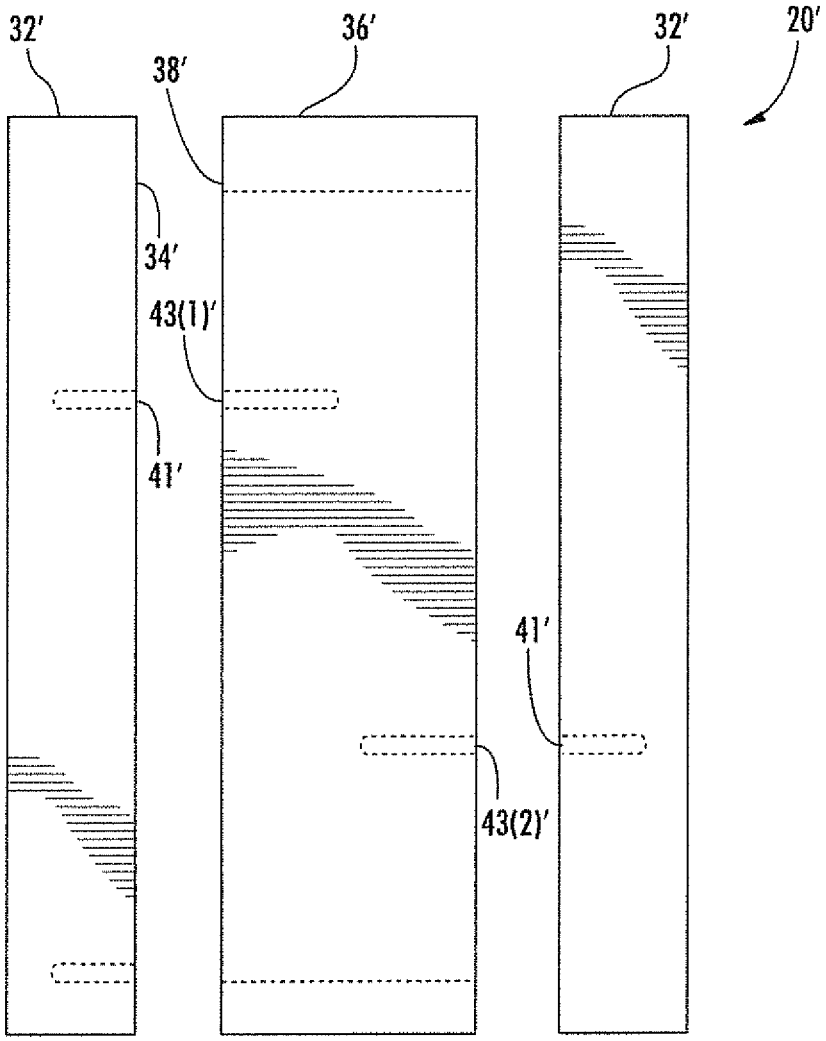
FIGS. 13-15 are top planer views of different embodiments of the cargo layer showing different positions for the openings that receive inserts in accordance with the present invention.

Alternative embodiments of the cargo layer will now be discussed in reference to FIGS. 13-15. In one embodiment, openings 34', 38' at opposing edges of the pallet 20' are the same as illustrated above so that a single insert 60' extends between the openings 34', 38' in the pair of horizontally positioned outer deck boards 32' and through the continuous opening in the at least one horizontally positioned intermediate deck board 36', as illustrated in FIG. 13. However, additional openings 41', 43' within the pallet 20' are staggered and only partially extend through the horizontally positioned intermediate deck board 36'.

The spaced apart openings 41', 43' in the horizontally positioned intermediate deck board 36' include a first partially extending opening 43(1)' through one of the sidewalls and a second partially extending opening 43(2)' through the other sidewall. The first and second partially extending openings 43(1)', 43(2)' are not aligned and do not extend through to the opposing sidewall. In this embodiment, separate inserts extend between openings in the pair of horizontally positioned outer deck boards 41' and the first and second partially extending openings 43(1)', 43(2)' in the horizontally positioned intermediate deck board 36'.

Figure 14:
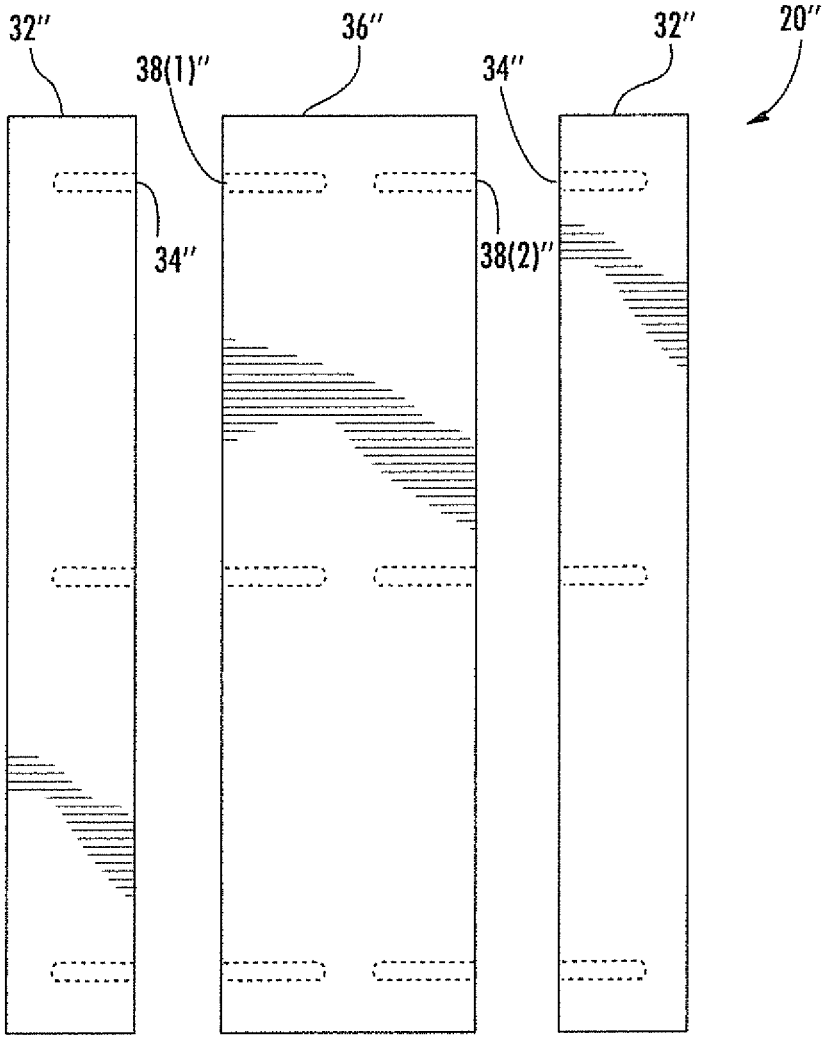
Figure 15:
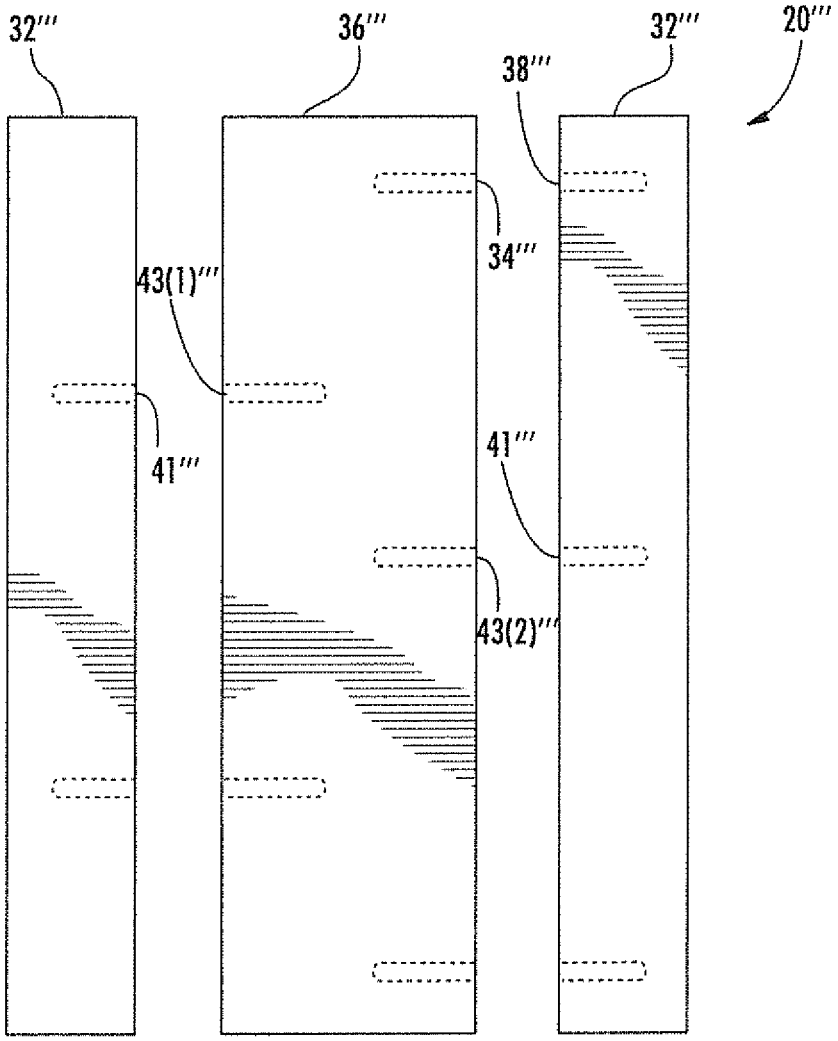

In yet another embodiment, the openings 34", 38" in the pallet 20" are aligned but do not contact one another within the horizontally positioned intermediate deck board 36", as illustrated in FIG. 14. In this embodiment, the inserts comprise separate inserts extending between openings 34" in the pair of horizontally positioned outer deck boards 32" and the first and second partially extending openings 38(1)", 38(2)" in the horizontally positioned intermediate deck board 36".

Figure 16:
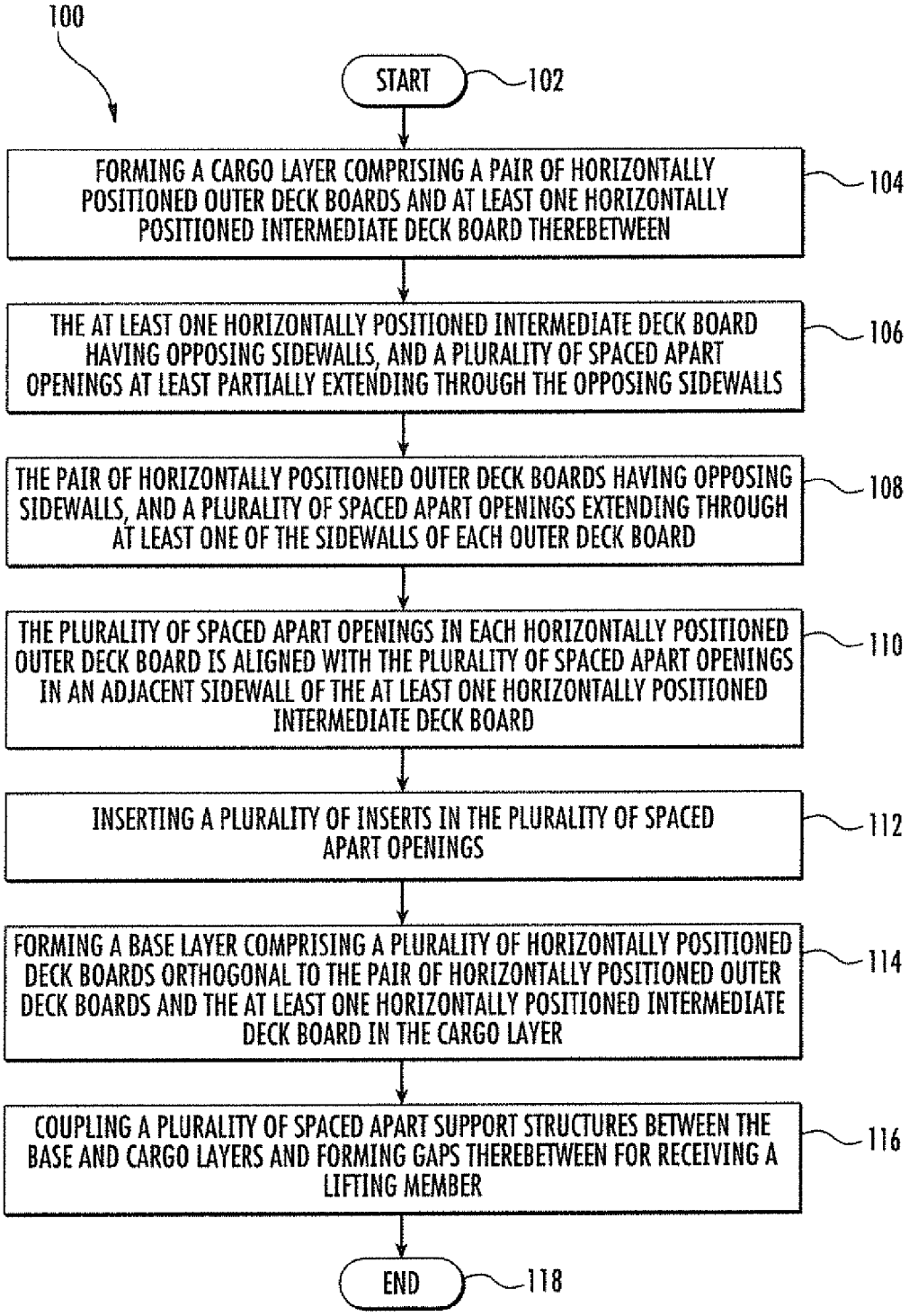
FIG. 16 is a flowchart illustrating a method for making a pallet in accordance with the present invention.

In yet another embodiment, the openings 34''', 38''' and 41''', 43(1)''' and 41''', 43(2)''' in the pallet 20" are not aligned within the pallet 20''', as illustrated in FIG. 16. Instead, each of the openings are staggered with respect to one another. A flowchart 100 illustrating a method for making a pallet 20 will now be discussed in reference to FIG. 12. From the start (Block 102), the method comprises forming a cargo layer 30 at Block 104 comprising a pair of horizontally positioned outer deck boards 32 and at least one horizontally positioned intermediate deck board 36 therebetween.

The at least one horizontally positioned intermediate deck board 36 is formed at Block 106 to have opposing sidewalls 37, and a plurality of spaced apart openings 38 extending through the opposing sidewalls. The pair of horizontally positioned outer deck boards 32 is formed at Block 108 to have opposing sidewalls 33(1) and 33(2), and a plurality of spaced apart openings 34 extending through at least one of the sidewalls 33(1) of each outer deck board. The plurality of spaced apart openings 34 in the pair of horizontally positioned outer deck boards 32 are aligned at Block 110 with the plurality of spaced apart openings 38 in the at least one horizontally positioned intermediate deck board 36 so as to form a plurality of spaced apart sets of aligned insert openings extending within the cargo layer 30.

The method further comprises inserting a plurality of inserts 60 in the plurality of spaced apart sets of aligned insert openings at Block 112. The base layer 50 is formed at Block 114 to comprise a plurality of horizontally positioned deck boards 50(1)-50(3) orthogonal to the pair of horizontally positioned outer deck boards 32 and the at least one horizontally positioned intermediate deck board 36 in the cargo layer 30. The method further comprises at Block 116 coupling a plurality of spaced apart support structures 40 between the base and cargo layers 50, 30 and forming gaps therebetween for receiving a lifting member. The method ends at Block 118.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is clamed is:

1. A pallet comprising:

a cargo layer comprising a pair of horizontally positioned outer deck boards and at least one horizontally positioned intermediate deck board therebetween, said at least one horizontally positioned intermediate deck board having opposing sidewalls and opposing upper and lower surfaces extending between the opposing sidewalls, with a thickness of the opposing sidewalls being less than a width of the opposing upper and lower surfaces, and a plurality of spaced apart openings at least partially extending through the opposing sidewalls between the opposing upper and lower surfaces, and said pair of horizontally positioned outer deck boards having opposing sidewalls and opposing upper and lower surfaces extending between the opposing sidewalls, with a thickness of the opposing sidewalls being less than a width of the opposing upper and lower surfaces, and a plurality of spaced apart openings extending through at least one of the sidewalls between the opposing upper and lower surfaces of each outer deck board, the plurality of spaced apart openings in the sidewalls of each horizontally positioned outer deck board being aligned with the plurality of spaced apart openings in an adjacent sidewall of said at least one horizontally positioned intermediate deck board;

a plurality of inserts in the plurality of spaced apart openings, with each insert extending between and being enclosed by the opposing upper and lower surfaces of at least one horizontally positioned outer deck board and at least one horizontally positioned intermediate deck board, and between each outer deck board and an immediately adjacent intermediate deck board there is a gap exposing said plurality of inserts extending therebetween;

a base layer comprising a plurality of horizontally positioned deck boards orthogonal to said pair of horizontally positioned outer deck boards and said at least one horizontally positioned intermediate deck board in said cargo layer; and a plurality of spaced apart support structures coupled between said base and cargo layers and forming gaps therebetween for receiving a lifting member, said plurality of spaced apart support structures comprising at least six, with each support structure having a C-shape with top and bottom flanges where each of the top flanges directly contact the outer or intermediate deck boards in the cargo layer.

2. The pallet according to claim 1 wherein each insert is orthogonal to said pair of horizontally positioned outer deck boards and said at least one horizontally positioned intermediate deck board in said cargo layer.

3. The pallet according to claim 1 wherein the plurality of spaced apart openings at least partially extending through the opposing sidewalls of said at least one horizontally positioned intermediate deck board includes a first partially extending opening through one of the sidewalls and a second partially extending opening through the other sidewall, with the first and second partially extending openings being aligned and contacting one another so as to form a continuous opening therethrough; and wherein said plurality of inserts comprises a single insert extending between openings in said pair of horizontally positioned outer deck boards and through the continuous opening in said at least one horizontally positioned intermediate deck board.

4. The pallet according to claim 1 wherein the plurality of spaced apart openings at least partially extending through the opposing sidewalls of said at least one horizontally positioned intermediate deck board includes a first partially extending opening through one of the sidewalls and a second partially extending opening through the other sidewall, with the first and second partially extending openings being aligned but not contacting one another; and wherein said plurality of inserts comprises separate inserts extending between openings in said pair of horizontally positioned outer deck boards and the first and second partially extending openings in said at least one horizontally positioned intermediate deck board.

5. The pallet according to claim 1 wherein the plurality of spaced apart openings at least partially extending through the opposing sidewalls of said at least one horizontally positioned intermediate deck board includes a first partially extending opening through one of the sidewalls and a second partially extending opening through the other sidewall, with the first and second partially extending openings not being aligned and not extending through to the opposing sidewall; and wherein said plurality of inserts comprises separate inserts extending between openings in said pair of horizontally positioned outer deck boards and the first and second partially extending openings in said at least one horizontally positioned intermediate deck board.

6. The pallet according to claim 1 wherein each insert comprises a pipe.

7. The pallet according to claim 1 wherein said pair of horizontally positioned outer deck boards and said at least one horizontally positioned intermediate deck board has a height of H, and wherein an outside diameter of each insert is within a range of 0.25 H and 0.75 H.

8. The pallet according to claim 7 wherein H is equal to 1 inch, and wherein the outside diameter of each insert is within a range of 0.25 and 0.75 inches.

9. The pallet according to claim 1 wherein each insert overlies a respective horizontally positioned deck board in said base layer.

10. The pallet according to claim 1 further comprising a plurality of fasteners coupling said base and cargo layers to said plurality of spaced apart support structures.

11. A method for making a pallet comprising:

forming a cargo layer comprising a pair of horizontally positioned outer deck boards and at least one horizontally positioned intermediate deck board therebetween, the at least one horizontally positioned intermediate deck board having opposing sidewalls and opposing upper and lower surfaces extending between the opposing sidewalls, with a thickness of the opposing sidewalls being less than a width of the opposing upper and lower surfaces, and a plurality of spaced apart openings at least partially extending through the opposing sidewalls between the opposing upper and lower surfaces, the pair of horizontally positioned outer deck boards having opposing sidewalls and opposing upper and lower surfaces extending between the opposing sidewalls, with a thickness of the opposing sidewalls being less than a width of the opposing upper and lower surfaces, and a plurality of spaced apart openings extending through at least one of the sidewalls between the opposing upper and lower surfaces of each outer deck board, and the plurality of spaced apart openings in the sidewalls of each horizontally positioned outer deck board is aligned with the plurality of spaced apart openings in an adjacent sidewall of the at least one horizontally positioned intermediate deck board;

inserting a plurality of inserts in the plurality of spaced apart sets of aligned insert openings, with each insert extending between and being enclosed by the opposing upper and lower surfaces of at least one horizontally positioned outer deck board and at least one horizontally positioned intermediate deck board, and between each outer deck board and an immediately adjacent intermediate deck board there is a gap exposing said plurality of inserts extending therebetween;

forming a base layer comprising a plurality of horizontally positioned deck boards orthogonal to the pair of horizontally positioned outer deck boards and the at least one horizontally positioned intermediate deck board in the cargo layer; and coupling a plurality of spaced apart support structures between the base and cargo layers and forming gaps therebetween for receiving a lifting member, the plurality of spaced apart support structures comprising at least six, with each support structure having a C-shape with top and bottom flanges where each of the flanges directly contact the outer or intermediate deck boards in the cargo layer.

12. The method according to claim 11 wherein each insert is orthogonal to the pair of horizontally positioned outer deck boards and the at least one horizontally positioned intermediate deck board in the cargo layer.

13. The method according to claim 11 wherein the plurality of spaced apart openings at least partially extending through the opposing sidewalls of the at least one horizontally positioned intermediate deck board includes a first partially extending opening through one of the sidewalls and a second partially extending opening through the other sidewall, with the first and second partially extending openings being aligned and contacting one another so as to form a continuous opening therethrough; and wherein the plurality of inserts comprises a single insert extending between openings in the pair of horizontally positioned outer deck boards and through the continuous opening in the at least one horizontally positioned intermediate deck board.

14. The method according to claim 11 wherein the plurality of spaced apart openings at least partially extending through the opposing sidewalls of the at least one horizontally positioned intermediate deck board includes a first partially extending opening through one of the sidewalls and a second partially extending opening through the other sidewall, with the first and second partially extending openings being aligned but not contacting one another; and wherein the plurality of inserts comprises separate inserts extending between openings in the pair of horizontally positioned outer deck boards and the first and second partially extending openings in the at least one horizontally positioned intermediate deck board.

15. The method according to claim 11 wherein the plurality of spaced apart openings at least partially extending through the opposing sidewalls of the at least one horizontally positioned intermediate deck board includes a first partially extending opening through one of the sidewalls and a second partially extending opening through the other sidewall, with the first and second partially extending openings not being aligned and not extending through to the opposing sidewall; and wherein the plurality of inserts comprises separate inserts extending between openings in the pair of horizontally positioned outer deck boards and the first and second partially extending openings in the at least one horizontally positioned intermediate deck board.

16. The method according to claim 11 wherein each insert comprises a pipe.

17. The method according to claim 11 wherein the pair of horizontally positioned outer deck boards and the at least one horizontally positioned intermediate deck board has a height of H, and wherein an outside diameter of each insert is within a range of 0.25 H and 0.75 H.

18. The method according to claim 17 wherein H is equal to 1 inch, and wherein the outside diameter of each insert is within a range of 0.25 and 0.75 inches.

19. The method according to claim 11 wherein each insert overlies a respective horizontally positioned deck board in the base layer.

* * * * *